United States Patent [19]

Kim

[11] Patent Number: 4,493,866

[45] Date of Patent: Jan. 15, 1985

[54] COSMETIC TOWEL

[76] Inventor: Yoon H. Kim, 19812 50th W. #614, Lynnwood, Wash. 98036

[21] Appl. No.: 547,570

[22] Filed: Nov. 1, 1983

[51] Int. Cl.[3] ..... A47L 17/00; B32B 7/04

[52] U.S. Cl. ..... 428/101; 15/118; 15/210 R; 604/378; 604/384; 604/385

[58] Field of Search ..... 428/101; 15/118, 210 R; 604/378, 384, 385

[56] References Cited

U.S. PATENT DOCUMENTS

| | | | |
|---|---|---|---|
| 1,716,364 | 6/1929 | Avery | 428/101 |
| 2,020,668 | 11/1935 | Wandel | 428/101 |
| 4,275,105 | 6/1981 | Boyd et al. | 604/370 |

FOREIGN PATENT DOCUMENTS

| | | | |
|---|---|---|---|
| 032793 | 7/1981 | European Pat. Off. | 15/210 R |

*Primary Examiner*—James C. Cannon

*Attorney, Agent, or Firm*—Fleit, Jacobson, Cohn & Price

[57] ABSTRACT

A cosmetic towel or the like for removing moisture from the skin without rubbing or chafing which comprises a piece of smooth, slick fabric, at least two pieces of gauze-like material which are layered on each side of the smooth fabric, and two pieces of towel which are layered on each side of the gauze-like material, all layers of fabric being stiched together around the edges with sewing thread or the like.

7 Claims, 3 Drawing Figures

COSMETIC TOWEL

BACKGROUND OF THE INVENTION

The present invention relates to a cosmetic towel for removing moisture from the skin. More particularly, the present invention concerns a towel which will effectively remove moisture from the skin without rubbing or irritating abrasion. The cosmetic towel of the present invention can also be used to massage the skin by applying finger pressure without direct rubbing of the skin.

Conventional towels are soft to the touch when they are first used. However, after a conventional towel has been washed and dried many times, the loops which are formed on the surface of the towel become worn and the fine hairs of the fabric fall off and become short. As a result, the surface of the towel becomes rough, causing considerable irritation to delicate skin when it is used on the face.

Thus, the use of a conventional towel will repeatedly slough off skin cells and chafe the skin. This rubbing action can also cause abrasion or a slight skin disease. Of course, abrasion and rubbing can further irritate problem skin which may be characterized by pimples or other wounds on the face or swelled hair follicles and pores. Since these blemishes are raised on the skin, the outer skin is especially prone to sloughing and irritation from rubbing.

Further, the use of a conventional towel can also cause a woman's eyebrows and eyelashes to fall out. And, the soft skin of infants can be damaged when wiping moisture after washing the face or bathing with a conventional towel.

SUMMARY OF THE INVENTION

The present invention is a cosmetic towel or the like which is constructed in a sandwich-like manner by interposing a fabric having a smooth, slick surface between two pieces of gauze or the like. The surfaces of the gauze are then layered between two pieces of towel. Finally, the layers of fabric are joined together by stitching around the edges with sewing thread or the like.

Thus, it is an object of the present invention to provide a cosmetic towel for effectively removing moisture from the skin without rough rubbing of the skin or abrasive irritating motion.

It is a further object of the present invention to provide a cosmetic towel which will allow massage of the skin by finger-pressure without directly rubbing the skin.

Still further objects of the present invention will become apparent from the following description, drawings, and appended claims.

DETAILED DESCRIPTION OF THE DRAWINGS

Figure 1:
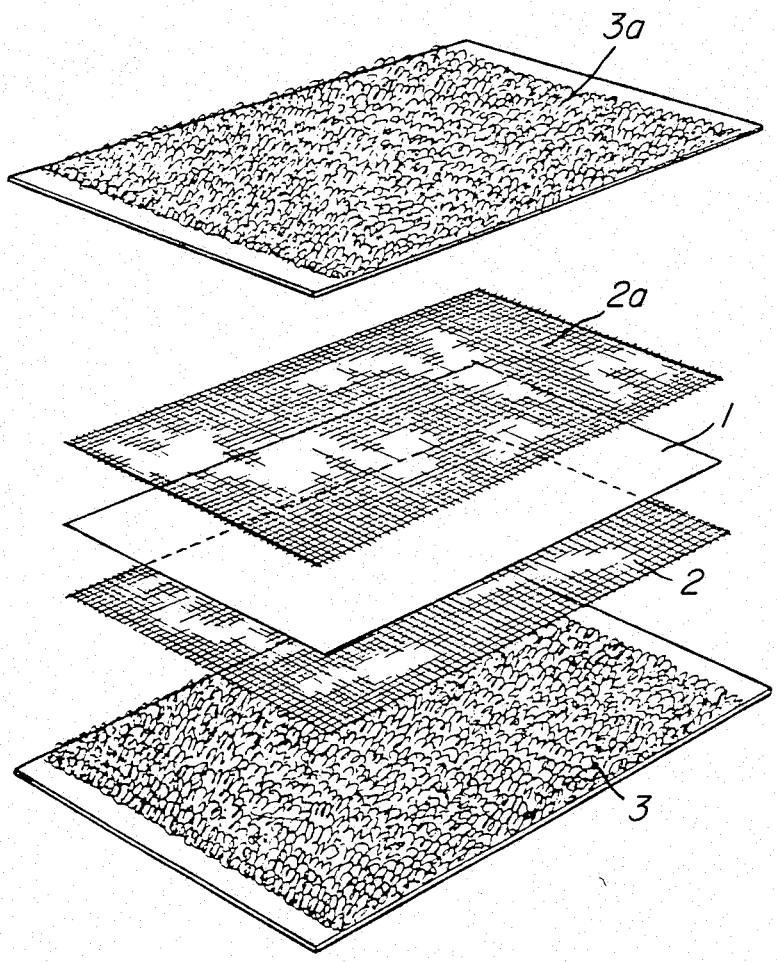
FIG. 1 is an exploded perspective view of the cosmetic towel of the present invention which shows each layer of the towel prior to stitching together.

Referring now to FIG. 1, the cosmetic towel of the present invention comprises at least two pieces of gauze 2,2*a* which are layered to each side of a piece of fabric

1 having a smooth slick surface, such as nylon or the like. At least two pieces of towel 3,3*a*, such as terrycloth or the like, comprise the outer surface of the cosmetic towel of the present invention.

Figure 2:
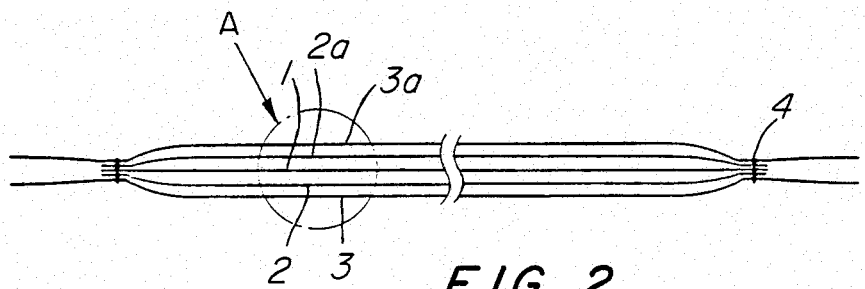
FIG. 2 is a cross-sectional side view of the cosmetic towel in FIG. 1 which shows the layers stitched together at the sides.

The cosmetic towel or the like is constructed in a sandwich-like manner by layering each piece of gauze 2,2*a* on each side of the piece of smooth fabric 1. The two surfaces of the gauze 2,2*a* are then layered between the two pieces of towel 3,3*a*. Finally, as shown in FIG. 2, the layers of fabric are joined together by stitching around the edges with sewing thread or the like.

Figure 3:
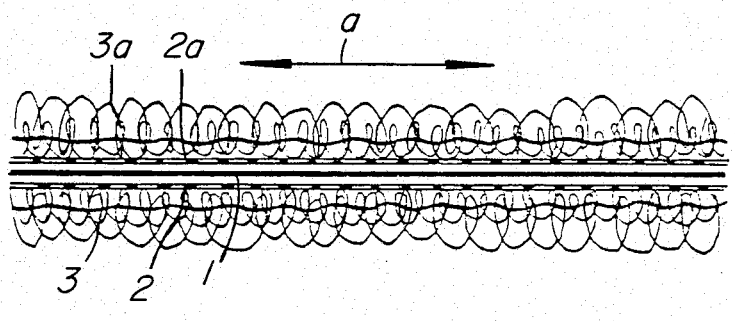
FIG. 3 is an enlarged cross-sectional view of the towel according to FIG. 2.

The cosmetic towel of the present invention is used by touching one side 3 of the towel to the skin, pressing the other side 3*a* of the towel slightly, and rubbing the side of the towel 3*a* in the direction shown by arrow (a) in FIG. 3. While side 3 of the towel remains stationary against the skin, the loops inside the towel 3*a* are caught in the gaps of the gauze 2*a* so that the towel 3*a* moves along the gauze 2*a* and easily slides back and forth against the smooth slick surface of fabric 1. Thus, only the effects of the finger-pressure on side 3*a* of the towel is transmitted to side 3 of the towel which is touching the skin. This action allows the cosmetic towel of the present invention to absorb moisture along the area of the towel under pressure from the fingers, without giving any rubbing stimulus to the skin.

The cosmetic towel of the present invention is particularly advantageous when absorbing moisture from blemished skin. Ordinarily, in such a case, you would press the skin firmly with a towel and pat the skin dry to avoid rubbing or an abrasive action along the contours of the face. However, it is now possible, with a cosmetic towel according to the present invention, to wipe away the moisture without irritating or damaging the blemished skin.

The cosmetic towel of the present invention offers a further advantage in that the face is gently massaged by the rubbing action and finger pressure applied when using the towel. Thus, use of the cosmetic towel has a beneficial effect on the beauty of the user.

Although one specific cosmetic towel has been described above, it should be understood that this embodiment is described for illustrative purposes only and that numerous alterations and modifications may be practiced by those skilled in the art without departing from the spirit and scope of the invention. Accordingly, it is the intent that the present invention not be limited to the above, but to be limited only as defined in the appended claims.

What is claimed is:

1. A cosmetic towel or the like comprising:

a planar piece of smooth, slick fabric, two pieces of gauze-like material, one of each of said two pieces of gauze-like material being layered on each side of said smooth fabric, and two pieces of towel, one each of said two pieces of towel being layered on each side of said gauze-like material, said layers of smooth fabric, gauze-like material and towel being stitched together around the edges with sewing thread or the like, the arrangement being such that each of the gauze layers is in movable relationship with the face of the smooth fabric with which it is superposed.

2. A cosmetic towel according to claim 1 wherein said smooth, slick fabric is nylon.

3. A cosmetic towel according to claim 1 wherein said towel is made of terrycloth.

4. A cosmetic towel or the like for use in removing moisture from delicate skin which comprises a layer of smooth, slick fabric, at least two layers of gauze-like material, and at least two layers of towel, said layers being assembled in a sandwich-like manner in the following order: a layer of towel, a layer of gauze-like material, a layer of smooth fabric, another layer of gauze-like material and another layer of towel, said layers being attached in an arrangement such that each of the gauze layers is in movable relationship with the face of the smooth fabric with which it is superposed.

5. A cosmetic towel according to claim 4 wherein said layers of smooth fabric, gauze-like material and towel are stitched together around the edges with sewing thread.

6. A cosmetic towel according to claim 4 wherein said layer of smooth fabric is nylon.

7. A cosmetic towel according to claim 4 wherein said layer of towel is terrycloth.

* * * * *